US008152648B2

(12) United States Patent
Shipley

(10) Patent No.: US 8,152,648 B2
(45) Date of Patent: Apr. 10, 2012

(54) WHITEWATER TERRAIN PARK SYSTEMS

(75) Inventor: Scott Richmond Shipley, Lyons, CO (US)

(73) Assignee: S2O Design and Engineering, Lyons, CO (US)

( * ) Notice: Subject to any disclaimer, the term of this patent is extended or adjusted under 35 U.S.C. 154(b) by 138 days.

(21) Appl. No.: 12/436,698

(22) Filed: May 6, 2009

(65) Prior Publication Data

US 2009/0280915 A1 Nov. 12, 2009

Related U.S. Application Data

(60) Provisional application No. 61/050,993, filed on May 6, 2008, provisional application No. 61/055,438, filed on May 22, 2008, provisional application No. 61/055,439, filed on May 22, 2008, provisional application No. 61/055,435, filed on May 22, 2008.

(51) Int. Cl.
*A63H 23/10* (2006.01)
*A63H 23/00* (2006.01)

(52) U.S. Cl. ..... 472/128; 472/117; 4/488

(58) Field of Classification Search ..... 472/13, 472/116, 117, 128, 129; 4/491, 496; 104/53, 104/69, 70
See application file for complete search history.

(56) References Cited

U.S. PATENT DOCUMENTS

| | | | | |
|---|---|---|---|---|
| 3,253,064 | A | 5/1966 | Buonaiuto | |
| 3,333,420 | A | 8/1967 | Henson | |
| 4,372,705 | A | 2/1983 | Atkinson | |
| 4,397,578 | A | 8/1983 | Inman | |
| 4,474,504 | A | 10/1984 | Whitman et al. | |
| RE32,663 | E | 5/1988 | Atkinson | |
| 4,963,057 | A * | 10/1990 | Fournier | 405/93 |
| 5,087,150 | A | 2/1992 | McCreary | |
| 5,421,782 | A | 6/1995 | Lochtefeld | |
| 5,443,326 | A | 8/1995 | Bernard et al. | |
| 5,453,054 | A * | 9/1995 | Langford | 472/88 |
| 5,704,294 | A * | 1/1998 | Van Winkle et al. | 104/73 |
| 5,855,481 | A | 1/1999 | Weichselbaum | |
| 6,454,659 | B1 | 9/2002 | Noble | |
| 6,475,095 | B1 | 11/2002 | Henry | |
| 6,743,108 | B2 | 6/2004 | Hunter | |
| 7,008,329 | B2 | 3/2006 | Hunter | |
| 7,229,359 | B2 | 6/2007 | Henry et al. | |
| 7,285,053 | B2 | 10/2007 | Henry et al. | |
| 2005/0090321 | A1 | 4/2005 | Henry et al. | |
| 2007/0049387 | A1 | 3/2007 | Henry et al. | |
| 2008/0101866 | A1 | 5/2008 | McLaughlin | |
| 2008/0101867 | A1 | 5/2008 | McLaughlin | |
| 2009/0280915 | A1 | 11/2009 | Shipley | |

FOREIGN PATENT DOCUMENTS

EP 0569499 11/1993

(Continued)

*Primary Examiner* — Kien Nguyen
(74) *Attorney, Agent, or Firm* — James M. Weatherly; Cochran Freund & Young LLC

(57) ABSTRACT

Disclosed is a whitewater park and whitewater park systems. A recreational waterfall system for traversal by watercraft that includes at least one headgate to produce a surge of water over a waterfall and to limit access to the waterfall by watercraft. A recreational watercraft launch that accelerates a watercraft while traversing said waterfall and a downstream crest a variable exit geometry causes the watercraft to be directed in an upward direction. A recreational waterfall has water flowing over a crest with variable cantilever determining a distance from the edge that the water flowing over the crest impacts water in the pool. A whitewater park has multiple routes of varying difficulties between pools.

3 Claims, 17 Drawing Sheets

FOREIGN PATENT DOCUMENTS

| | | |
|---|---|---|
| EP | 2069590 | 6/2009 |
| EP | 2122063 | 11/2009 |
| WO | 2008037928 | 4/2008 |
| WO | 2008084036 | 7/2008 |

* cited by examiner

WHITEWATER TERRAIN PARK SYSTEMS

CROSS-REFERENCE TO RELATED APPLICATIONS

This application claims the benefit of and priority to U.S. Provisional Application Ser. No. 61/050,993, filed May 6, 2008, by Scott Richmond Shipley, entitled "Waterfall Surge System," U.S. Provisional Application Ser. No. 61/055,438, filed May 22, 2008, by Scott Richmond Shipley, entitled "Waterfall Cantilever Crest System," U.S. Provisional Application Ser. No. 61/055,439, filed May 22, 2008, by Scott Richmond Shipley, entitled "Multiple Route Interlocking Waterfall System," and U.S. Provisional Application Ser. No. 61/055,435, filed May 22, 2008, by Scott Richmond Shipley, entitled "Waterfall Aerial Launch System," the entire contents of which are specifically incorporated by reference herein for all that they describe, show and teach, for all purposes.

BACKGROUND OF THE INVENTION

The past decades have witnessed phenomenal growth in the whitewater recreation industry. This increased growth not only has had an impact on the waters in rivers but has also lead to an increase in the number of manmade whitewater parks. Whitewater parks are often based on use of manmade geological formations to create as natural and exciting a whitewater experience as possible.

These manmade geological formations often create water currents that can create dangerous hydraulics at the base of a drop or waterfall. These dangerous hydraulics can become dangerous hazards for users of a whitewater park that can sometime lead to serious injuries or even death.

SUMMARY OF THE INVENTION

An embodiment of the invention may therefore comprise a recreational waterfall system for traversal by watercraft for amusement, comprising: a top pool; a bottom pool; and, a first headgate configured to release an amount of water to flow from said top pool to said bottom pool, said amount of water traversing a waterfall between said top pool and said bottom pool, a flow rate of water over said waterfall reaching a peak flow and ebbing back, said first headgate also configured to regulate a flow of watercraft traversing said waterfall, said amount of water being based on at least one of a dimension of said top pool, a dimension of a crest of said waterfall, and a geometry of said crest of the waterfall.

An embodiment of the invention may therefore further comprise a recreational watercraft launch, comprising: top pool supplying water and watercraft to a waterfall having an upstream crest; a downstream crest receiving water and watercraft that have flowed over said upstream crest and accelerated while traversing said waterfall, said downstream crest having a variable exit geometry; and, a bottom pool receiving said water and watercraft that have flowed over said downstream crest and been projected in an upward direction into said bottom pool, said bottom pool having a water surface elevation that is less than said downstream crest such that said water having traversed said downstream crest experiences flow separation as said water is shot into the air.

An embodiment of the invention may therefore further comprise a recreational waterfall system for traversal by watercraft for amusement, comprising: a crest, traversable by said watercraft and having water flowing over said crest to form a waterfall into a pool, said watercraft entering said pool by traversing said crest, said pool having an edge; and, a variable cantilever supporting said crest, said variable cantilever determining a first variable distance from said edge that said water flowing over said crest impacts water in said pool and a second variable distance from said edge that said watercraft flowing over said crest impacts water in said pool, said second variable distance being a safe distance away from hazards associated with said pool.

An embodiment of the invention may therefore further comprise manmade recreational whitewater park, comprising: a first pool at a first elevation; a second pool at a second elevation that is lower than the first elevation, the second pool receiving watercraft from said first pool via at least a first waterfall and a second waterfall, the first waterfall being associated with a first difficulty of navigation, the second waterfall being associated with a second difficulty of navigation; and, a third pool at a third elevation that is lower than the second elevation, the third pool receiving watercraft from said second pool via at least a third waterfall and a fourth waterfall.

DETAILED DESCRIPTION OF THE EMBODIMENTS

Figure 1:
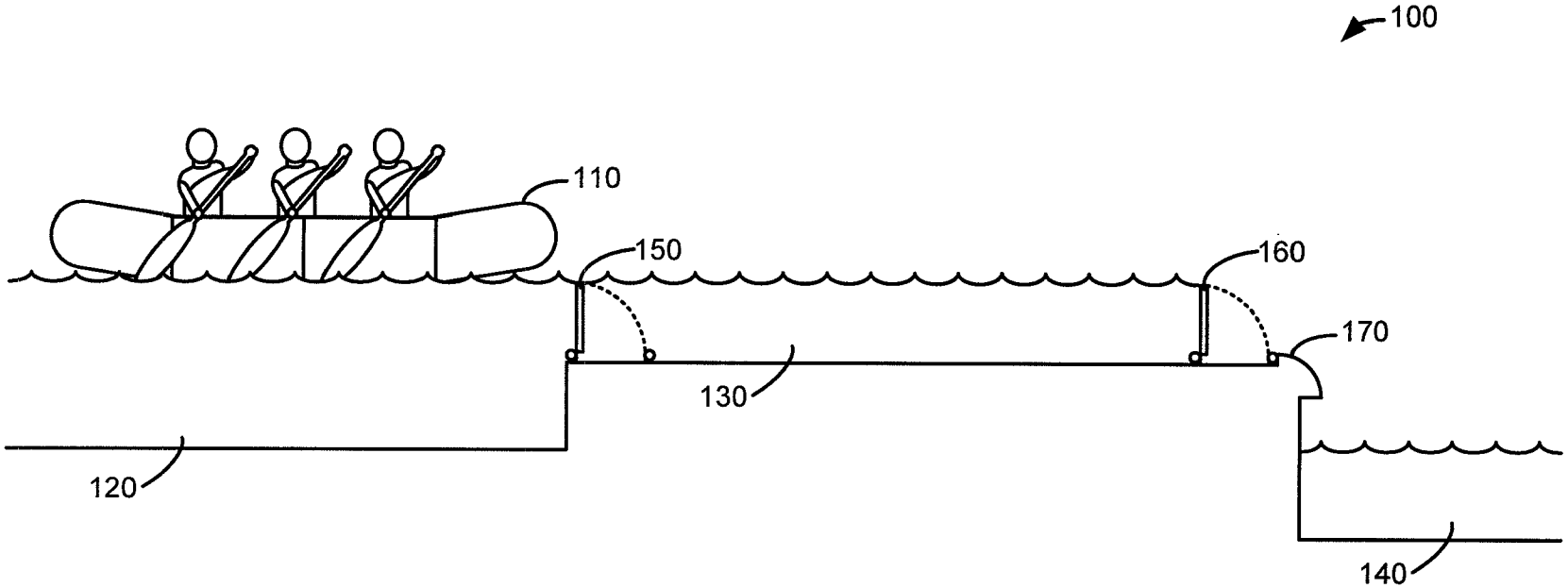
FIG. 1 is a diagram illustrating a dual-headgate waterfall surge system in a first configuration.

FIG. 1 is a diagram illustrating a dual-headgate waterfall surge system in a first configuration. In FIGS. 1-7, dual-headgate waterfall surge system 100 comprises watercraft 110, top pool 120, bottom pool 140, upstream headgate 150, downstream headgate 160, and crest 170. Top pool 120 includes release storage pond 130. Upstream headgate 150 lies between top pool 120 and release storage pond 130. Downstream headgate 160 lies between release storage pond 130 and crest 170. Crest 170 lies between headgate 160 and bottom pool 140. Crest 170 is at a higher elevation than the water surface level of bottom pool 140. Thus, crest 170 defines a drop or waterfall between top pool 120 and bottom pool 140. In operation, watercraft 110 navigates top pool 120, release storage pond 130, crest 170 to end up in bottom pool 140.

In an embodiment, top pool 120 is the pool or area in which the boater is stationed before proceeding over crest 170 into bottom pool 140. Release storage pond 130 is the canal, pool, or area at or near the top of crest 170 of a waterfall or pour-over area type drop. Bottom pool 140 is the pool or area in which watercraft 110 is landing in after traversing a waterfall or drop. Crest 170 is the edge that defines the boundary between bodies of water at the water surface elevation of top pool 120 and bodies of water that have begun to drop in elevation towards the bottom pool 140. Exit is the downstream edge that defines the boundary between the pour-over drop or waterfall and a catch drop.

A waterfall or drop is a wetted canal upon which water flows at an angle of drop or fall between 0° (vertical) and 120° between two pools (e.g., top pool and bottom pool) and which is used by watercraft 110 to navigate between these two pools. A waterfall or pour-over drop includes drops that may include vertical drops as well drops in elevation that may occur at greater or lesser angles.

Upstream headgate 150 is a gate or moveable barrier upstream from crest 170 and downstream headgate 160. Downstream headgate 160 is a gate or movable barrier on the downstream end of top pool 120. A headgate is in the open position when it is placed in a position that allows flows and watercraft 110 to pass over or by the headgate. A headgate is in the closed position when it is placed in a position that prohibits flows and watercraft 110 to pass over or by the headgate. Upstream headgate 150 and downstream headgate 160 may vary in size and composition. For example, headgates that may be used as either upstream headgate 150 or downstream headgate 160 include, but are not limited to: radial gates, tainter gates, simple lock gates, flap gates, Obermeyer gates, and/or lock gates.

Waterfall surge system 100 provides a canal or pool at or near crest 170 of a waterfall or pour-over type drop. This canal or pool is release storage pond 130. Water and watercraft 110 from the top pool 120 flow into release storage pond 130. In release storage pond 130, water and watercraft 110 within the release storage pond 130 are impounded by two head gates, stationed on the upstream and downstream ends of the release storage pond 130. These headgates are the upstream headgate 150 and downstream headgate 160, respectively. Release storage pond 130 may range in range in size from the minimal size/volume required to hold a single user and their watercraft 110 to sizes that could be much larger and would hold multiple watercrafts 110 and/or multiple users in a single watercraft 110.

Waterfall surge system 100 operates by deflecting or configuring upstream headgate 150 and downstream headgate 160 in open and closed positions in multiple stages or configurations. These configurations allow for the transfer of water into various pools (e.g., release storage pond 130) while also containing water from entering other pools (e.g., bottom pool 140).

A first of these configurations is illustrated in FIG. 1. In FIG. 1, both upstream headgate 150 and downstream headgate 160 in the closed positions. Water and watercraft 110 in top pool 120 are prohibited from flowing into the release storage pond because upstream headgate 150 is in the closed position.

Figure 2:
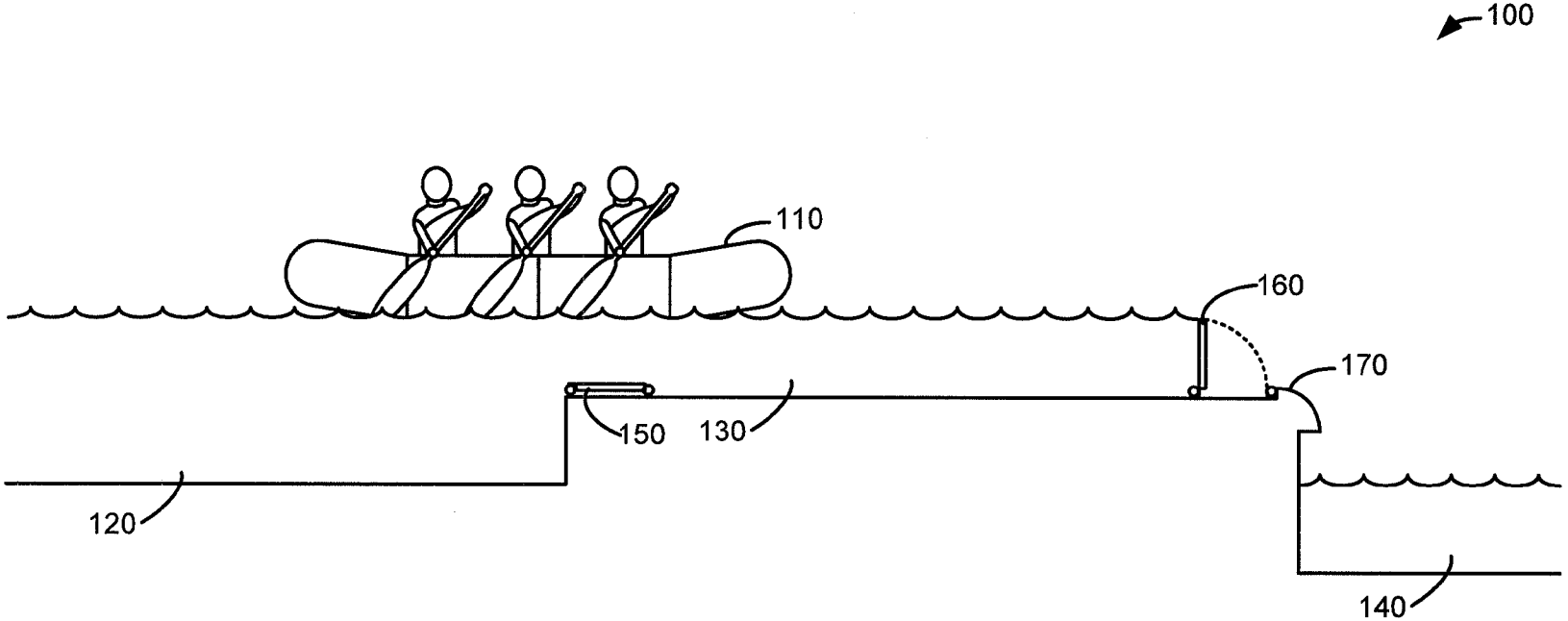
FIG. 2 is a diagram illustrating a dual-headgate waterfall surge system in a second configuration.

A second configuration is illustrated in FIG. 2. This second configuration would typically follow the first configuration. In the second configuration, upstream headgate 150 has been switched to the open position. This allows water and watercraft 110 to flow from top pool 120 into release storage pond 130. However, because downstream headgate 160 is in the closed position, water and watercraft 110 sit in the release storage pond 130. Water and watercraft 110 are prevented from going downstream over the crest 170 of a drop/waterfall by downstream headgate 160. The release storage pond 130, if not already fully charged, is allowed to charge to the desired water volume level.

Figure 3:
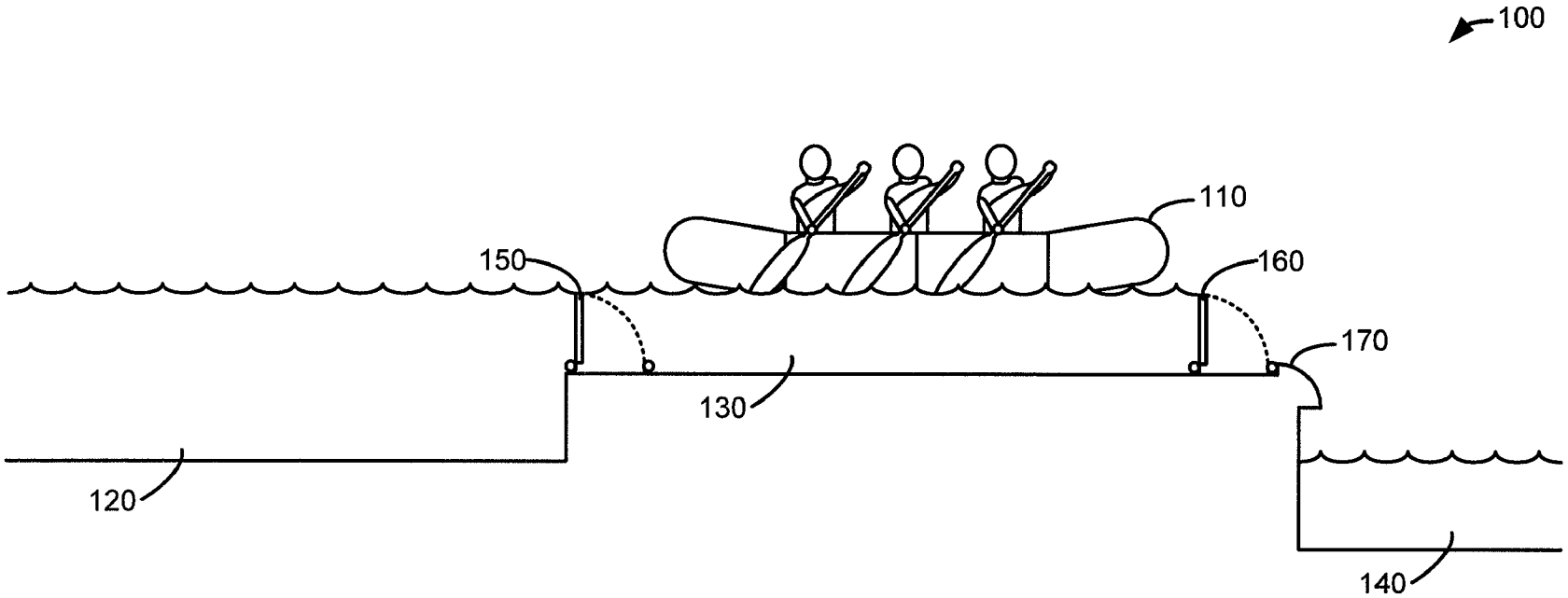
FIG. 3 is a diagram illustrating a dual-headgate waterfall surge system in a third configuration.

A third configuration is illustrated in FIG. 3. This third configuration would typically follow the second configuration. In the third configuration, the upstream headgate 150 is switched to the closed position. Because both upstream headgate 150 and downstream headgate 160 are in the closed position, water and watercraft 110 sit in release storage pond 130. Water and watercraft 110 are prevented from going upstream back into top pool 120 by upstream headgate 150. Water and watercraft 110 are prevented from going downstream over the crest 170 of a drop/waterfall by downstream headgate 160. Release storage pond 130 may contain a measured quantity of water. With downstream headgate 160 and upstream headgate 150 in a closed position, the measured quantity of water may be isolated in release storage pond 130.

An observer stationed above bottom pool 140 may visually determine whether bottom pool 140 is clear of other users, watercraft 110, or hazards and obstructions. The observer may then determine when waterfall surge system 100 is ready to proceed to the fourth configuration.

Figure 4:
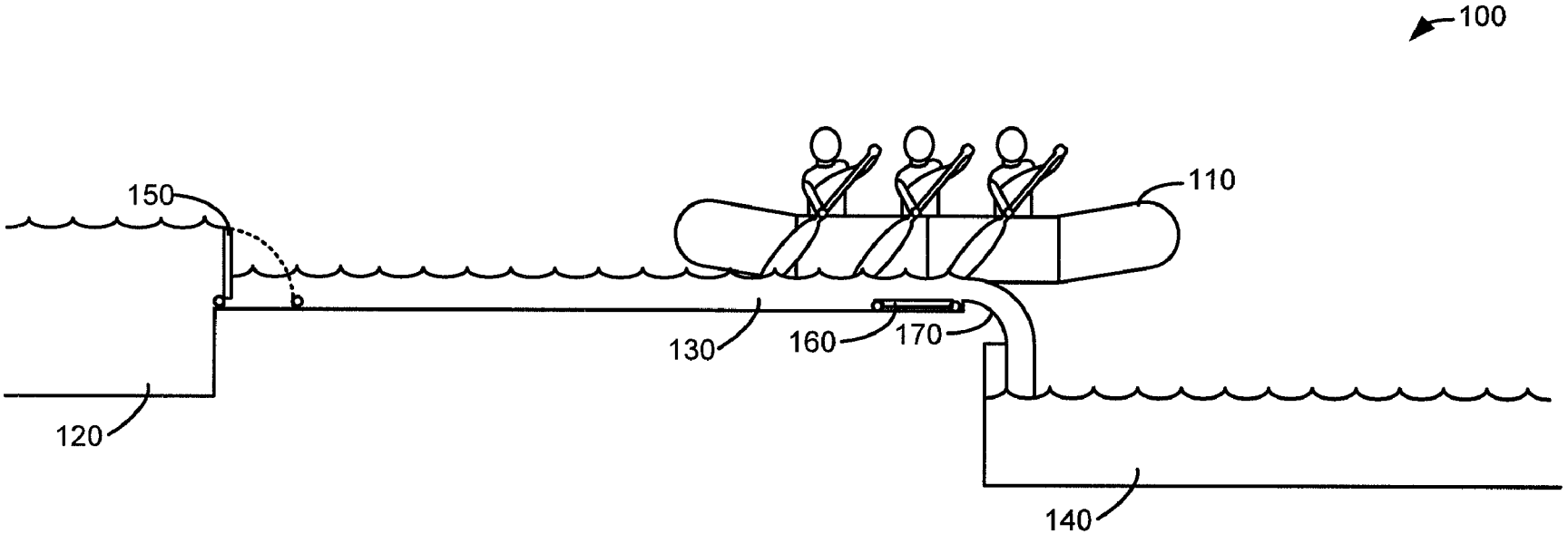
FIG. 4 is a diagram illustrating a dual-headgate waterfall surge system in a fourth configuration.

A fourth configuration is illustrated in FIG. 4. This fourth configuration would typically follow the third configuration. In FIG. 4, watercraft 110 is traversing crest 170. When the observer determines to proceed to the fourth configuration, upstream headgate 150 is maintained in the closed position. Downstream headgate 160 is configured to the open position. This can be done manually or automatically depending upon the size of downstream headgate 160, the amount of water in top pool 120, and the type of headgate chosen for the system.

Placing the downstream headgate 160 in the open position allows the flows isolated in release storage pond 130 to be released over crest 170 of the drop/waterfall. The users and watercraft 110 confined in release storage pond 130 are also released and able to navigate crest 170 and the drop/waterfall. The limited quantity of water isolated in release storage pond 130 ensures that the flows over the drop/waterfall reach a peak flow and ebb back to a flow of zero. The quantity of time that flows proceed over crest 170 to the exit of the drop/waterfall depend on several design factors including the dimensions of release storage pond 130, the dimensions of crest 170, and the geometry of crest 170. Water flows over crest 170 may be for the extent of time necessary to allow navigation of watercraft 110 over the drop/waterfall.

The flow of water from release storage pond 130 over the drop/waterfall into the bottom pool 140 creates a natural hydraulic in the area where the flow enters the water in the bottom pool. Once the flows have ebbed, the power of the hydraulic that was created at the exit of the drop/waterfall decreases to a point that allows for recovery and rescue, if necessary.

Figure 5:
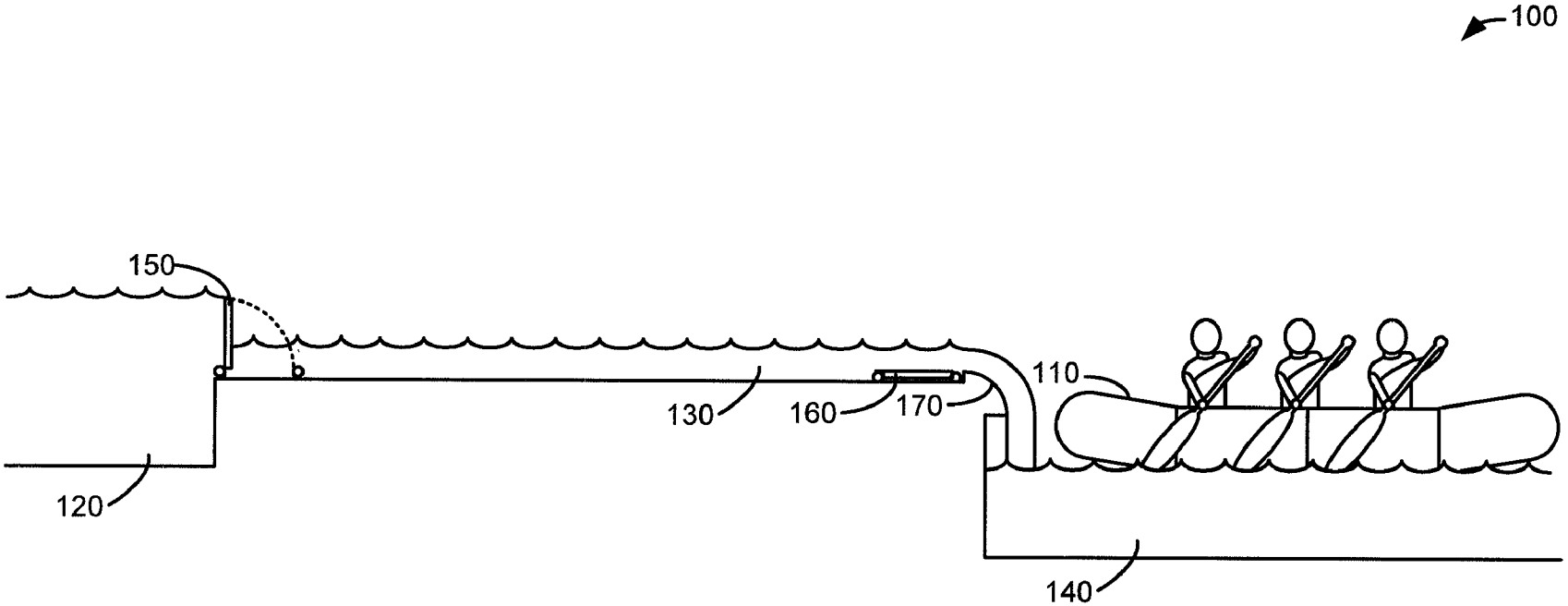
FIG. 5 is a diagram illustrating a dual-headgate waterfall surge system in a fifth configuration.

A fifth configuration is illustrated in FIG. 5. This fifth configuration would typically follow the fourth configuration. In FIG. 5, watercraft 110 has traversed crest 170 and is now positioned in bottom pool 140. Downstream headgate 160 remains in the open position.

Figure 6:
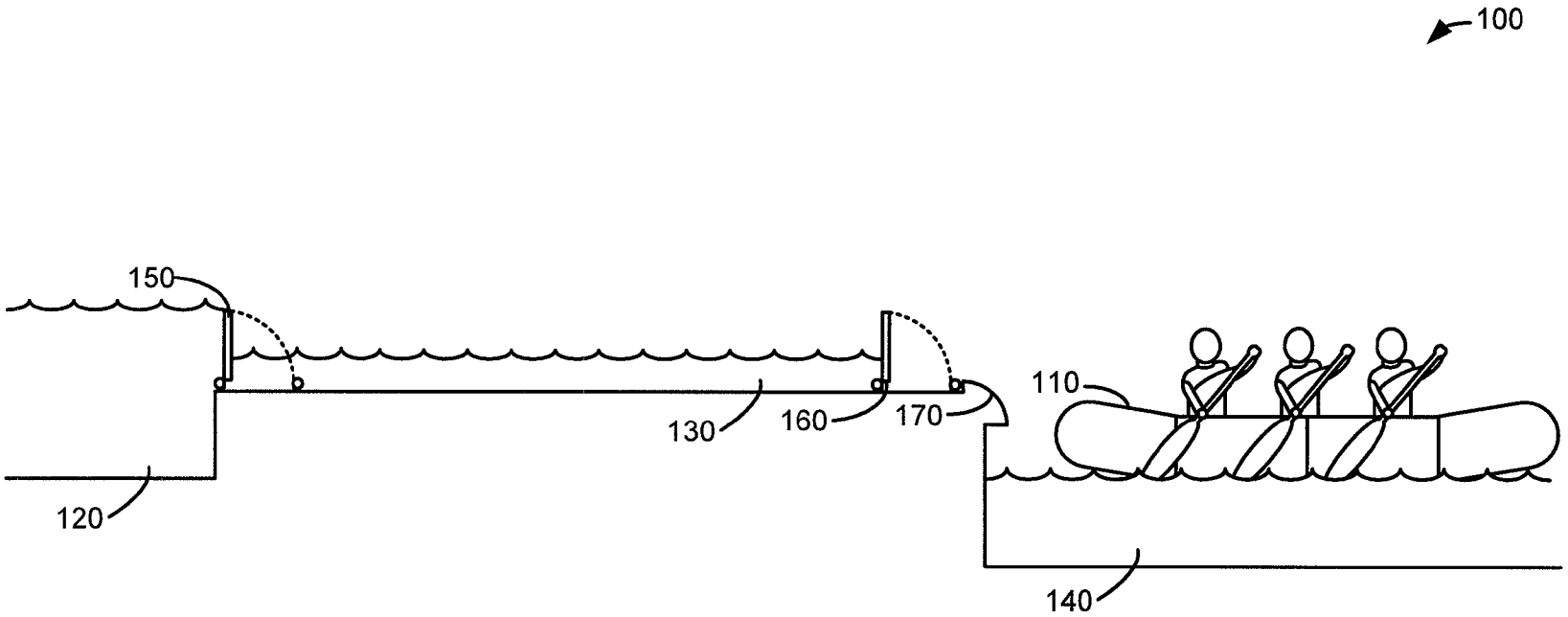
FIG. 6 is a diagram illustrating a dual-headgate waterfall surge system in a sixth configuration.

A sixth configuration is illustrated in FIG. 6. This sixth configuration would typically follow the fifth configuration. In FIG. 6, all of the water has been released from release storage pond 130. The observer may close downstream headgate 160 either manually or automatically. Thus, in FIG. 6, downstream headgate 160 is shown in the closed position.

Figure 7:
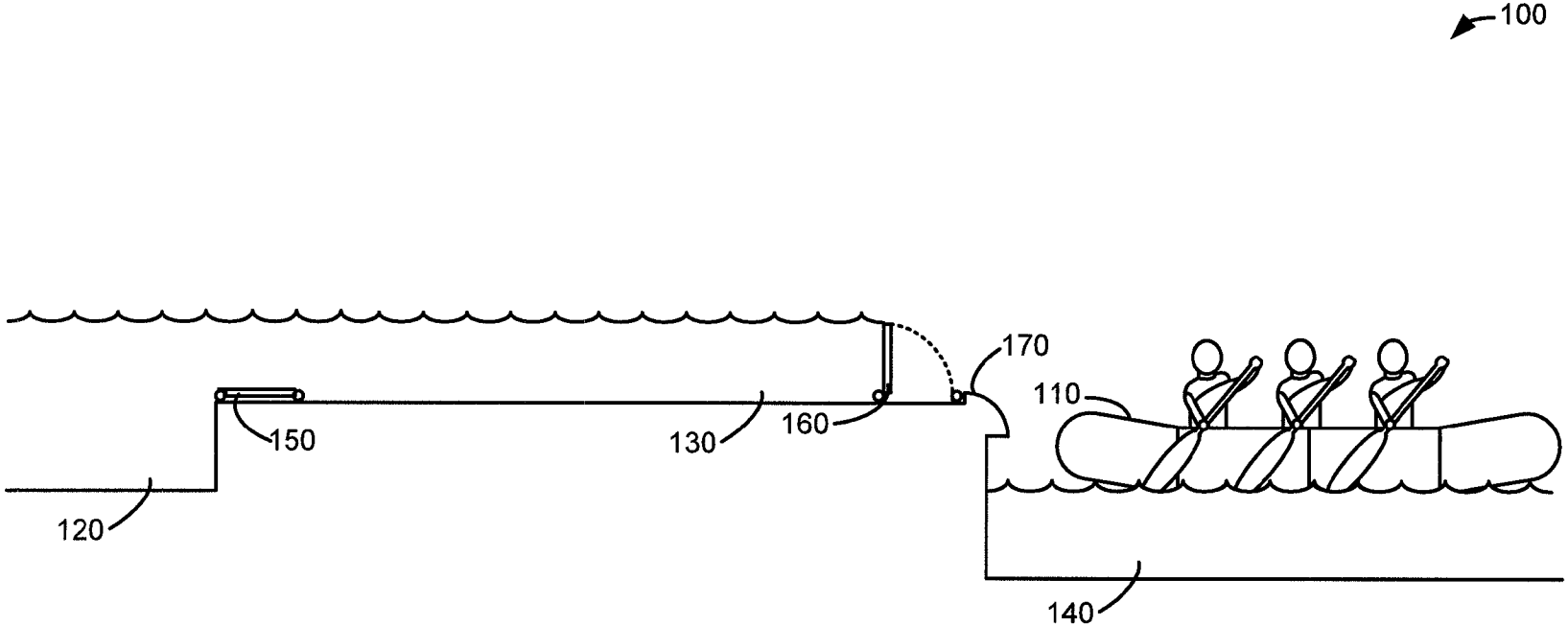
FIG. 7 is a diagram illustrating a dual-headgate waterfall surge system in a seventh configuration.

A seventh configuration is illustrated in FIG. 7. This seventh configuration would typically follow the sixth configuration. In FIG. 7, upstream headgate 150 is manually or automatically opened. Thus, flows from top pool 120 are thereby allowed to enter release storage pond 130 and recharge release storage pond 130. Flows in top pool 120 may act to raise the water surface elevation (or level) of top pool 120 and concurrently recharge release storage pond 130. The observer may then determine if release storage pond 130 has been fully charged. The observer may determine if a user has entered release storage pond 130 and is ready to proceed.

In an embodiment, a sensor or sensors stationed at various locations in release storage pond 130 and bottom pool 140 may send signals to a central processing unit (CPU). The CPU may analyze the data from the various sensor(s). Based on the analysis of the data from the sensor(s), the CPU may determine whether release storage pond 130 is occupied. The CPU may determine if bottom pool 140 is clear of watercraft 110 or other hazards.

Once the CPU determines that release storage pond 130 is unoccupied by one or more users, the CPU may send a signal that releases upstream headgate 150 into the open position. When upstream headgate 150 is in the open position, water and watercraft 110 may flow from top pool 120 into release storage pond 130. Watercraft 110 then sits in release storage pond 130 as release storage pond 130 fills to a necessary volume. Watercraft 110 is prevented from going downstream over the drop/waterfall by the downstream headgate 160. Release storage pond 130, if not already fully charged, is allowed to charge to a desired level.

Sensor(s) stationed at various locations above and around bottom pool 140 send data to a CPU which analyzes the data. Based upon the analysis of the data from the sensor(s), the CPU determines whether the bottom pool is clear of other users, hazards, and/or obstructions. The central processing unit then determines when to proceed.

Once the CPU determines it is ready to proceed, the CPU sends a signal to upstream headgate 150 to move to the closed position. The CPU sends a signal to the downstream headgate 160 to move to the open position.

Placing downstream headgate 160 in the open position allows the flows isolated in release storage pond 130 to be released over the drop/waterfall. The users and watercraft 110 confined in release storage pond 130 are also released and able navigate the drop/waterfall. The limited quantity of water isolated in release storage pond 130 ensures that the flows over the drop/waterfall reach a peak flow and are able to ebb back to a flow of zero.

The quantity of time that flows proceed over crest 170 to the exit of the drop/waterfall into bottom pool 140 is dependent on several design factors including the dimensions of release storage pond 130, the dimensions of crest 170, and the geometry of crest 170.

The flow of water from release storage pond 130 over the drop/waterfall into bottom pool 140 creates a natural hydraulic in the area where the flow enters the water in bottom pool 140. Once the flows ebb, the power of the hydraulic that has been created at the exit of the drop/waterfall decreases to a point that allows for recovery and rescue, if necessary. A sensor or sensors stationed at various locations above and around bottom pool 140 send data to a CPU regarding whether an obstacle or user is still in bottom pool 140.

Once all of the water has been released, and the CPU determines that the bottom pool is safe to enter, the CPU sends a signal to close downstream headgate 160. The CPU also sends a signal to open upstream headgate 150. Flows from top pool 120 are thereby allowed to enter release storage pond 130 and recharge as well as refill release storage pond 130. Based upon data from various signals, the CPU then determine if release storage pond 130 is fully charged. The CPU also determines if a user has entered release storage pond 130 and whether to proceed.

The aforementioned sensors include but are not limited to water volume sensor, Lidar sensors, optical sensors, and/or water temperature sensors. Transferring the data from the sensor or sensors to the CPU unit may be accomplished in a number of ways, either wireless or hard wired. Any type of telemetry system that allows for the delivery of sensor-derived information from the field to a CPU or by way of fixed wires or optical cables is acceptable. In the previous discussion, a CPU was used to open and close upstream headgate 150 and the downstream headgate 160 and to analyze the data from the sensor or sensors. Any data analysis software may be used in this process.

Figure 8:
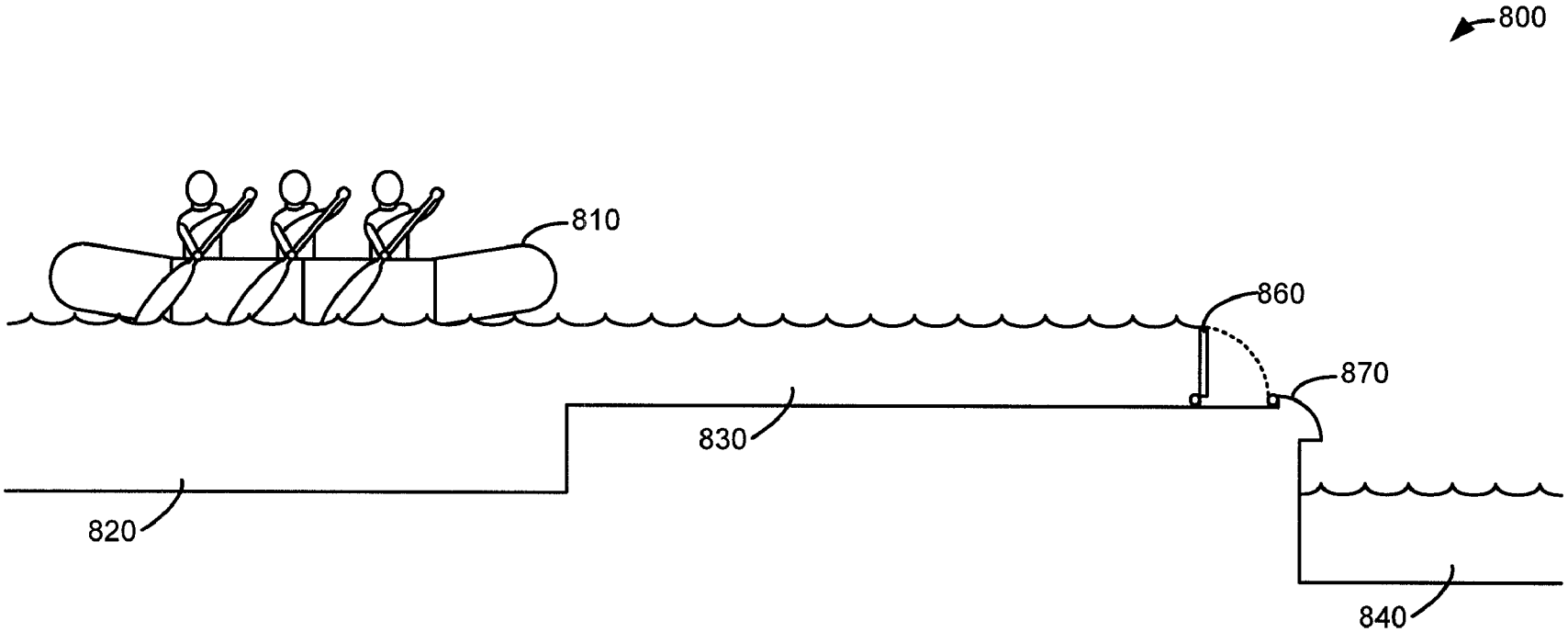
FIG. 8 is a diagram illustrating a single-headgate waterfall surge system in a first configuration.
Figure 9:
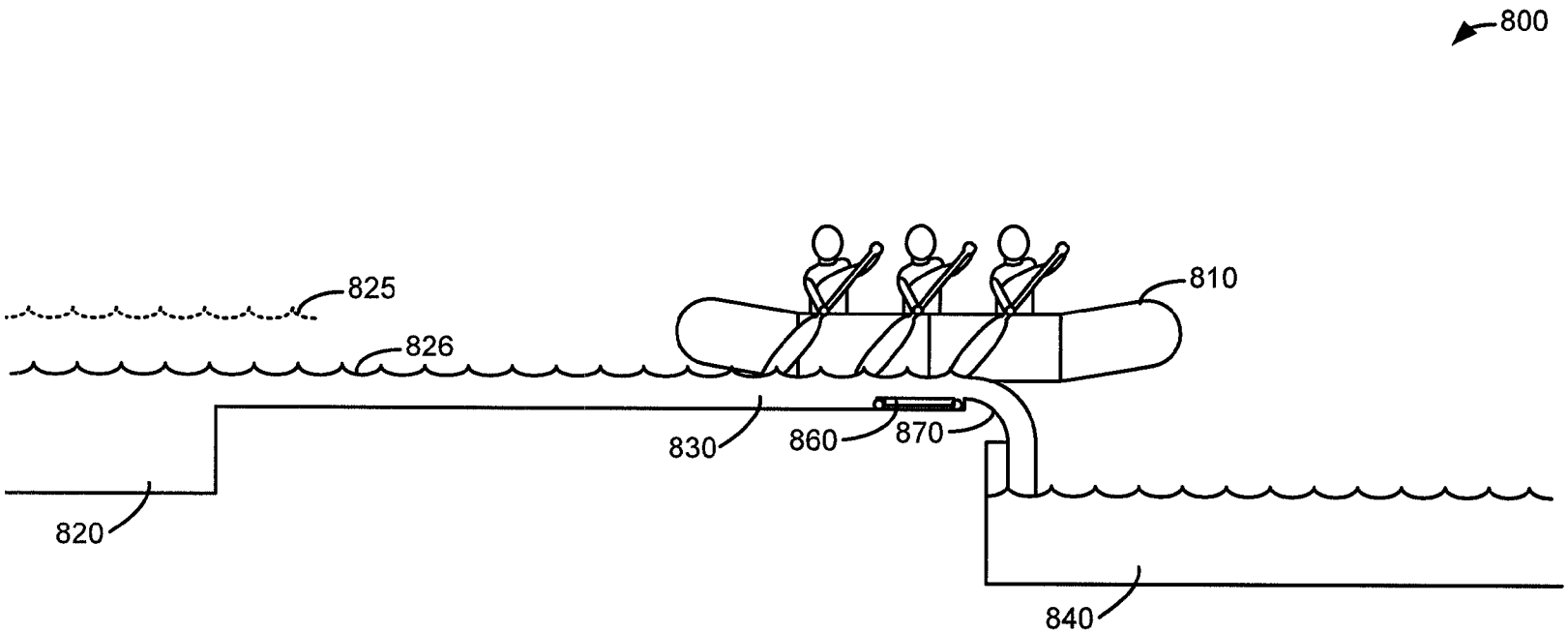
FIG. 9 is a diagram illustrating a single-headgate waterfall surge system in a second configuration.
Figure 10:
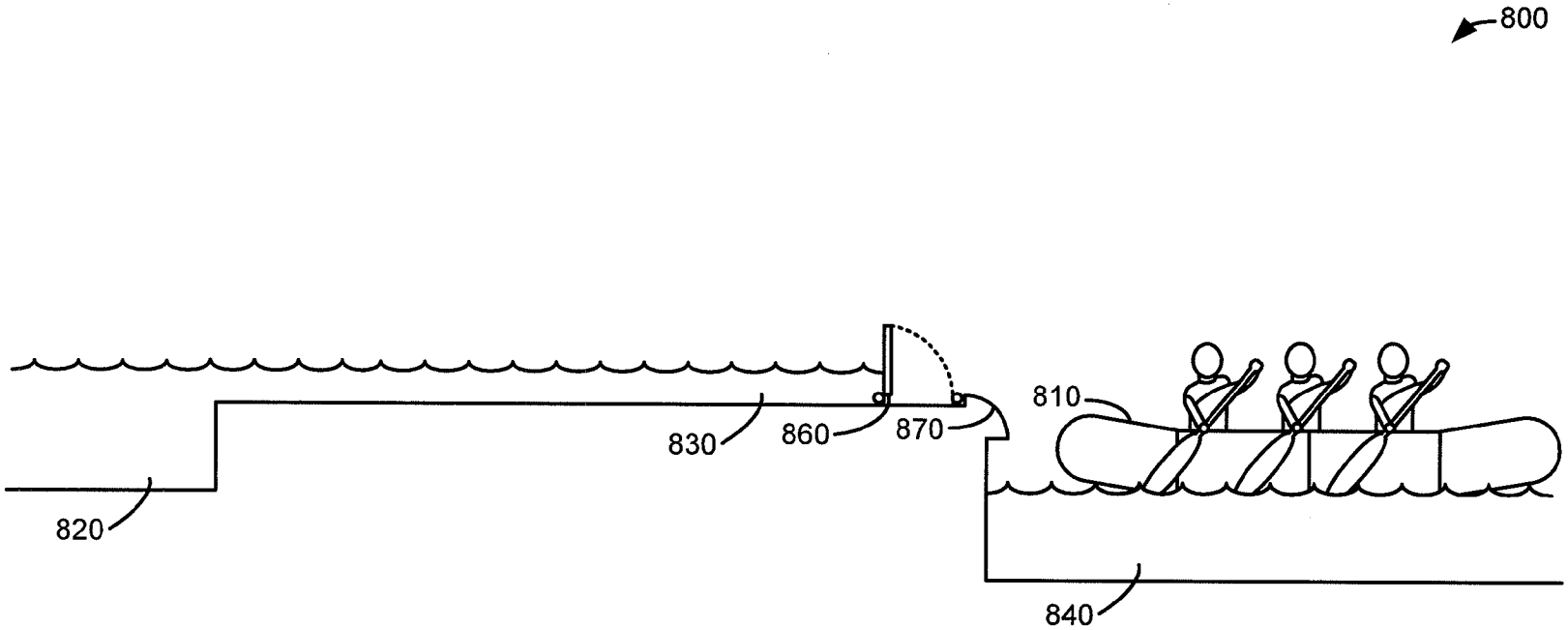
FIG. 10 is a diagram illustrating a single-headgate waterfall surge system in a third configuration.

FIG. 8 is a diagram illustrating a single-headgate waterfall surge system in a first configuration. In FIGS. 8-10, single-headgate waterfall surge system 800 comprises watercraft 810, top pool 820, bottom pool 840, headgate 860, and crest 870. Top pool 820 includes release storage pond 830. Headgate 860 lies between release storage pond 830 and crest 870. Crest 870 lies between headgate 860 and bottom pool 840. Crest 870 is at a higher elevation than the water surface level of bottom pool 840. Thus, crest 870 defines a drop or waterfall between top pool 820 and bottom pool 840. In operation, watercraft 810 navigates top pool 820 and crest 870 to end up in bottom pool 840.

In an embodiment, top pool 820 is the pool or area in which the boater is stationed before proceeding over crest 870 into bottom pool 840. Release storage pond 830 is a canal, pool, or area that is a part of top pool 820, and is at or near the top of crest 870 of a waterfall or pour-over area type drop. Top pool 820 can range in size and depth from the minimal size/volume required to hold a single user and their watercraft 810 to sizes that could be much larger and would hold multiple watercrafts 810 and/or multiple users in a single watercraft 810. Bottom pool 840 is the pool or area in which watercraft 810 lands after traversing a waterfall or drop. Crest 870 is the edge that defines the boundary between bodies of water at the water surface elevation of top pool 820 and bodies of water that have begun to drop in elevation towards the bottom pool 840. Exit is the downstream edge that defines the boundary between the pour-over drop or waterfall and a catch drop.

A waterfall or drop is a wetted canal upon which water flows at an angle of drop or fall between 0° and 120° between two pools (e.g., top pool and bottom pool) and which is used by watercraft 810 to navigate between these two pools. A waterfall or pour-over drop includes drops that may include vertical drops as well drops in elevation that may occur at greater or lesser angles.

Headgate 860 is a gate or movable barrier on the downstream end of top pool 820. Headgate 860 is in the open position when it is placed in a position that allows flows and watercraft 810 to pass over or by headgate 860. Headgate 860 is in the closed position when it is placed in a position that prohibits flows and watercraft 810 to pass over or by headgate 860. Headgate 860 may vary in size and compositions.

Examples of headgates that may be used as headgate 860 include, but are not limited to: radial gates, tainter gates, simple lock gates, flap gates, Obermeyer gates, and/or lock gates.

Single-headgate waterfall surge system 800 is operated by deflecting headgate 860 from the open positions and closed positions in multiple separate configurations to allow for the transfer of water into various pools while also containing water from entering other pools or flowing over the drop and into bottom pool 840.

A first of these configurations is illustrated in FIG. 8. In FIG. 8, headgate 860 is in the closed position. Water and watercraft 810 in top pool 820 are prohibited from flowing over the drop because headgate 860 is in the closed position.

An observer may be stationed above bottom pool 840 to visually determine whether bottom pool 840 is clear of other users or hazards and obstructions. The observer may determine when to proceed. Determination of a clear bottom pool 840 may also be made through the use of a sensor(s) and a CPU as described previously.

FIG. 9 is a diagram illustrating a single-headgate waterfall surge system in a second configuration. This second configuration would typically follow the first configuration. Once it is determined to proceed to the second configuration, headgate 860 is configured to the open position. This can be done manually or automatically depending upon the size of headgate 860, the amount of water in top pool 820, and the type of head gate chosen for the system. Placing headgate 860 in the open position allows the flows in top pool 820 to be released over the drop/waterfall. The users and watercraft 810 confined in top pool 820 are also released and able to navigate the drop/waterfall. The limited quantity of water isolated in top pool 820 as well as the geometry of headgate 860 ensures that the flows over the drop/waterfall reach a peak flow and are able to ebb back to a flow of zero. The quantity of time that flows proceed over crest 870 to the exit of the drop/waterfall is dependent on several design factors including the dimensions of top pool 820, the dimensions of crest 870, and the geometry of the crest 870. Water may flow over the drop/waterfall for an extent of time necessary to allow navigation of watercraft 810 over the drop/waterfall. As water flows out of top pool 820, the water surface level 825 of top pool 820 may drop to a lower water surface level 826.

The flow of water from top pool 820 over the drop/waterfall into bottom pool 840 creates a natural hydraulic in the area where the flow enters the water in bottom pool 840. Once the flows ebb, the power of the hydraulic that has been created at the exit of the drop/waterfall decreases to a point that allows for recovery and rescue, if necessary.

FIG. 10 is a diagram illustrating a single-headgate waterfall surge system in a third configuration. This third configuration would typically follow the second configuration. An observer may close headgate 860 either manually or automatically. Flows into top pool 820 are thereby allowed to recharge the lost water in top pool 820. The observer may then determine if top pool 820 has been fully charged and if a user has entered top pool 820 and is ready to proceed.

The previously described waterfall surge systems feature a system to control the surge of water over a waterfall or pour-over type drop. The waterfall surge system is designed to control the dangerous hydraulics and water currents associated with a waterfall or pour-over type drop while also controlling the flow and amount and timing of kayakers, canoers, rafters and other watercraft users over a waterfall or pour-over type drop.

Generally speaking, with the increasing popularity of whitewater recreation and whitewater parks, these parks are becoming increasingly crowded and often dangerous. With the increased popularity of whitewater parks the likelihood of dangerous encounters between recreational users of the whitewater parks also increases. These encounters often occur in highly dangerous areas of a whitewater park such as a difficult obstacle or drop. Often a user of the whitewater park will reach the crest of a drop or waterfall without any knowledge whether exit of the drop or waterfall is clear of other users or hazards. This can create a dangerous situation where a user can either land on another user of the whitewater park or land on an obstacle that has become trapped in the hydraulics of the drop. The previously described waterfall surge systems provide mechanisms to regulate the flow of water and/or users safely through a whitewater parks in order to minimize the amount of human encounters with dangerous water currents and hydraulics or with other users.

Figure 11:
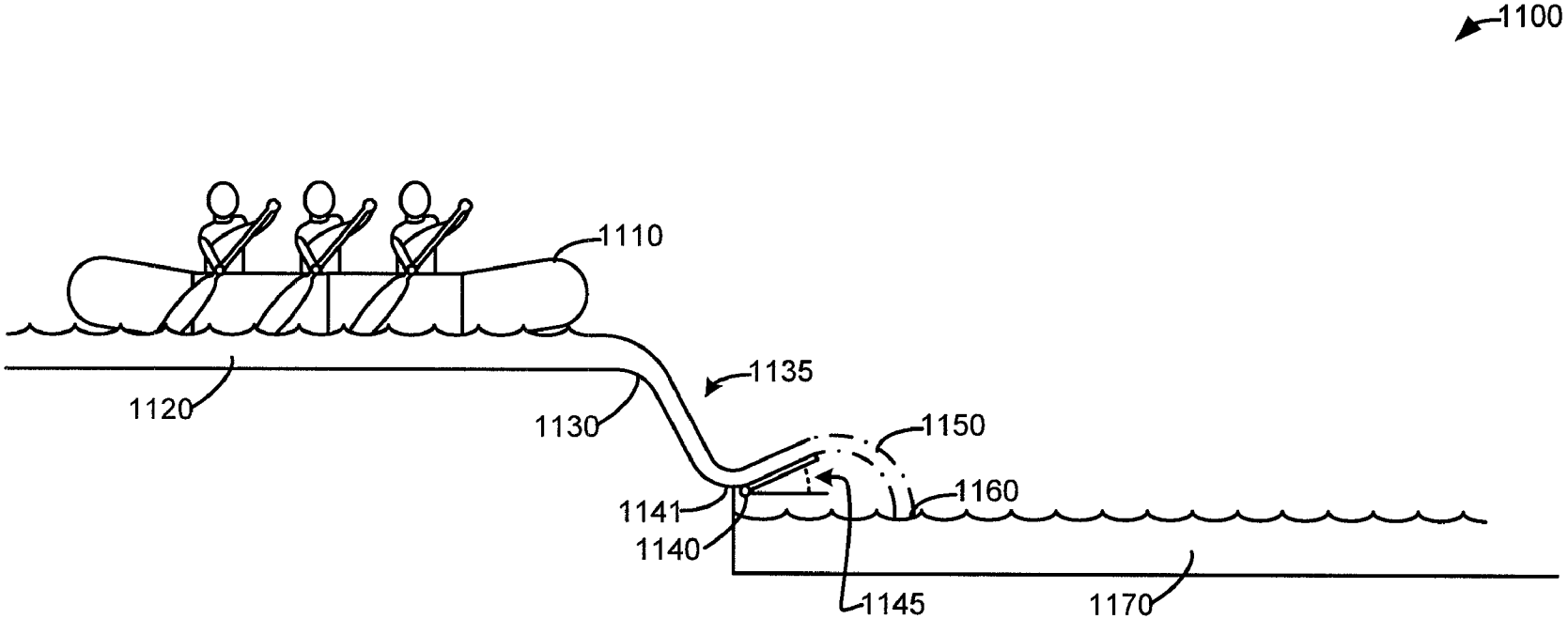
FIG. 11 is a diagram illustrating recreational waterfall launch in a first configuration.
Figure 12:
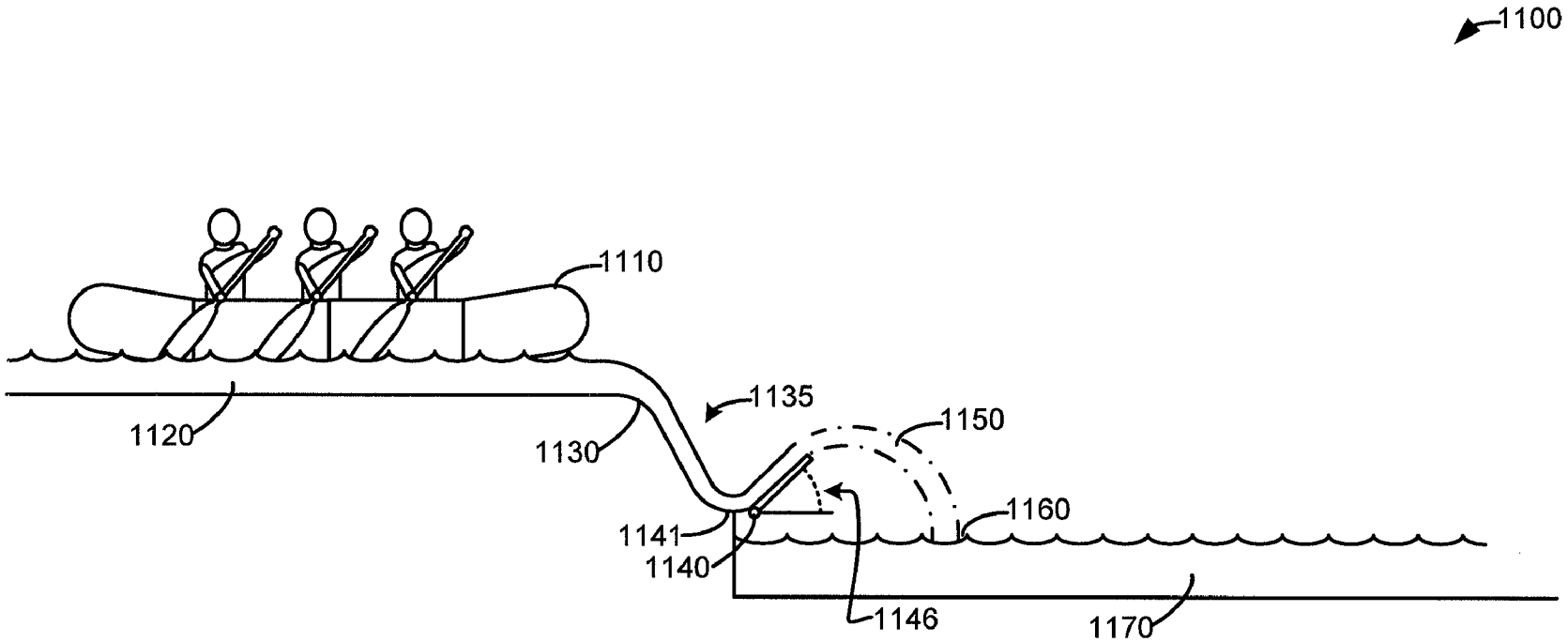
FIG. 12 is a diagram illustrating recreational waterfall launch in a second configuration.

FIG. 11 is a diagram illustrating recreational waterfall launch in a first configuration. FIG. 12 is a diagram illustrating recreational waterfall launch in a second configuration. In FIGS. 11-12, waterfall launch system 1100 comprises watercraft 1110, top pool 1120, upstream crest 1130, waterfall 1135, platform 1140, downstream crest 1141, nappe 1150, exit 1160, and bottom pool 1170. In FIG. 11, a first launch angle is shown by reference numeral 1145. In FIG. 12, a second launch angle, which is greater than the first launch angle, is shown by reference numeral 1146.

In FIGS. 11-12, watercraft 1110 is shown in top pool 1120. Upstream crest 1130 is shown between top pool 1120 and waterfall 1135. Waterfall 1135 is shown between upstream crest 1130 and downstream crest 1141. Platform 1140 is shown redirecting water flowing down waterfall 1135 at an upward angle which is initially greater than an angle parallel with the surface of bottom pool 1170. This upward projection of water is shown as nappe 1150. Nappe 1150 arcs from platform 1140 to meet the surface of bottom pool 1170 at exit 1160.

In an embodiment, top pool 1120 is the pool or area in which the boater is stationed before proceeding over upstream crest 1130 on a course into bottom pool 1170. Bottom pool 1170 is the pool or area in which watercraft 1110 lands after traversing waterfall 1135 and platform 1140. Upstream crest 1130 is the edge that defines the boundary between bodies of water at the water surface elevation of top pool 1120 and bodies of water that have begun to drop in elevation towards the bottom pool 1170 (e.g., waterfall 1135). Downstream crest 1141 is the edge that defines the downstream most point on waterfall launch system 1100 that is wetted by waters flowing over upstream crest 1130. Downstream crest 1141 is defined by flow separation as the flows are shot into the air. Exit 1160 is the edge that defines the boundary between the pour-over drop and bottom pool 1170. In other words, Exit 1160 is the point at which water pouring over the waterfall/drop impacts bottom pool 1170. Platform 1140 is a device or platform positioned at the downstream portion of waterfall 1135 that is designed to change the trajectory of a watercraft 1110 that is navigating waterfall 1135 such that the watercraft 1110 is shot upward into the air. Watercraft 1110 may be shot upward into the air prior to impact with bottom pool 1170. Nappe 1150 is a sheet of water.

A waterfall or drop is a wetted canal upon which water flows at an average angle of drop or fall between 0° (parallel to the bottom pool) and 90° between two pools (e.g., top pool 1120 and bottom pool 1170) and which is used by watercraft 1110 to navigate between these two pools. A waterfall or pour-over drop includes drops that may include vertical drops as well drops in elevation that may occur at greater or lesser angles.

In an embodiment, waterfall launch system 1100 comprises one or more platforms 1140 that are designed to launch a watercraft that is navigating down a waterfall 1135 at an upward angle which is initially greater than the angle which is parallel with the surface of the downstream pool. Waterfall launch system 1100 sits in the flow of the water flowing over upstream crest 1130 of waterfall 1135 and redirects the angle of the falling water, such that it is guided into a desired landing zone in bottom pool 1170 and such that the water and any watercraft 1110 that negotiate the waterfall launch system 1100, are projected from downstream crest 1141 in an upward direction.

In an embodiment, waterfall launch system 1100 has top pool 1120 that approaches and is connected to upstream crest 1130 of waterfall 1135. A watercraft 1110 that is intent on navigating waterfall 1135 will approach waterfall 1135 through top pool 1120.

Top pool 1120 can range in size from the minimal size/volume required to hold a single user and their watercraft 1110 to sizes that could be much larger and would hold multiple watercrafts 1110 and/or multiple users in a single watercraft 1110. Top pool 1120 may be a canal.

Upstream crest 1130 of the waterfall 1135 can also vary in size and composition depending on the intended purpose or experience of waterfall 1135. Additionally, the nature of waterfall 1135 can vary in size and composition depending on the intended purpose or experience of waterfall 1135. In some cases waterfall 1135 may be vertical which will allow a watercraft 1110 (e.g., canoe, kayak, or raft) to fall vertically before watercraft 1110's direction is redirected by elements of waterfall launch system 1100 such that watercraft 1110 exits waterfall 1135 in an upward direction.

In use, watercraft 1110 accelerates down waterfall 1135. Watercraft 1110's momentum is changed by downstream crest 1141 and/or platform 1140. The resulting change in momentum caused by downstream crest 1141 and/or platform 1140 redirects watercraft 1110 in a direction vector that is away from downstream crest 1141 in a direction parallel to the surface of bottom pool 1170, as well as a vector that is upward in a direction opposite to the direction of gravity.

In a simple case of navigation, watercraft 1110 impacts the surface of bottom pool 1170 at a desired attitude and velocity as set by a designer of waterfall launch system 1100. In the case that the boater has affected the attitude of watercraft 1110 through effort or alignment, the impact attitude of watercraft 1110 may be set by these actions.

In another embodiment, waterfall 1135 may not be vertical but may mimic a slide that falls at an angle less than vertical before the watercraft 1110's direction is redirected by elements of waterfall launch system 1100. In each case, the amount of drop must be sufficient to allow the watercraft 1110 to navigate waterfall launch system 1100 without the need for additional speed or energy.

An example of waterfall launch system 1100 includes an embodiment that changes watercraft 1110's movement such that watercraft 1110 is launched upward and away from downstream crest 1141 at a very slight angle and just above the water's surface. Another example includes an embodiment that launches the boater and watercraft 1110 at a much more dramatic upward angle such that watercraft 1110 is propelled higher above the water's surface and will have sufficient room to allow the user and watercraft 1110 to effect a spinning about one or more of watercraft 1110's axes.

The launch angle and surface geometry of the present invention can be varied to accomplish several objectives. These objectives include, but are not limited to adjusting the angle that the water/nappe impacts the bottom pool, adjusting the character of the hydraulic formed at the point where the water/nappe meets bottom pool 1170, and adjusting the launch angle 1145-1146 at which the boater is launched upwards and then the subsequent angle that, in the absence of further effort by the boater, watercraft 1110 impacts into bottom pool 1170.

In an embodiment, waterfall launch system 1100 comprises at least one waterfall 1135 to generate sufficient speed and momentum and elements that evolve watercraft 1110's momentum into an upward direction before watercraft 1110 reaches downstream crest 1140 of waterfall 1135. The upward direction can include any angle between level with the surface of bottom pool 1170 to an angle just less than vertical.

In another embodiment, waterfall launch system 1100 may employ a variable cantilever supporting a crest. In this embodiment, waterfall launch system 1100 may be permanently constructed to feature a downstream crest 1141 launch angle 1145 or 1146 that is very small but, once the cantilever crest is attached, the downstream crest 1141 launch angle 1145 or 1146 would be higher. In this embodiment less experienced boaters may choose to navigate the waterfall launch system 1100 when the cantilever crest is not attached and more experienced boaters may choose to navigate waterfall launch system 1100 when the cantilever crest is attached. An example of a cantilever crest is described in association with FIGS. 13 and 14.

Figure 13:
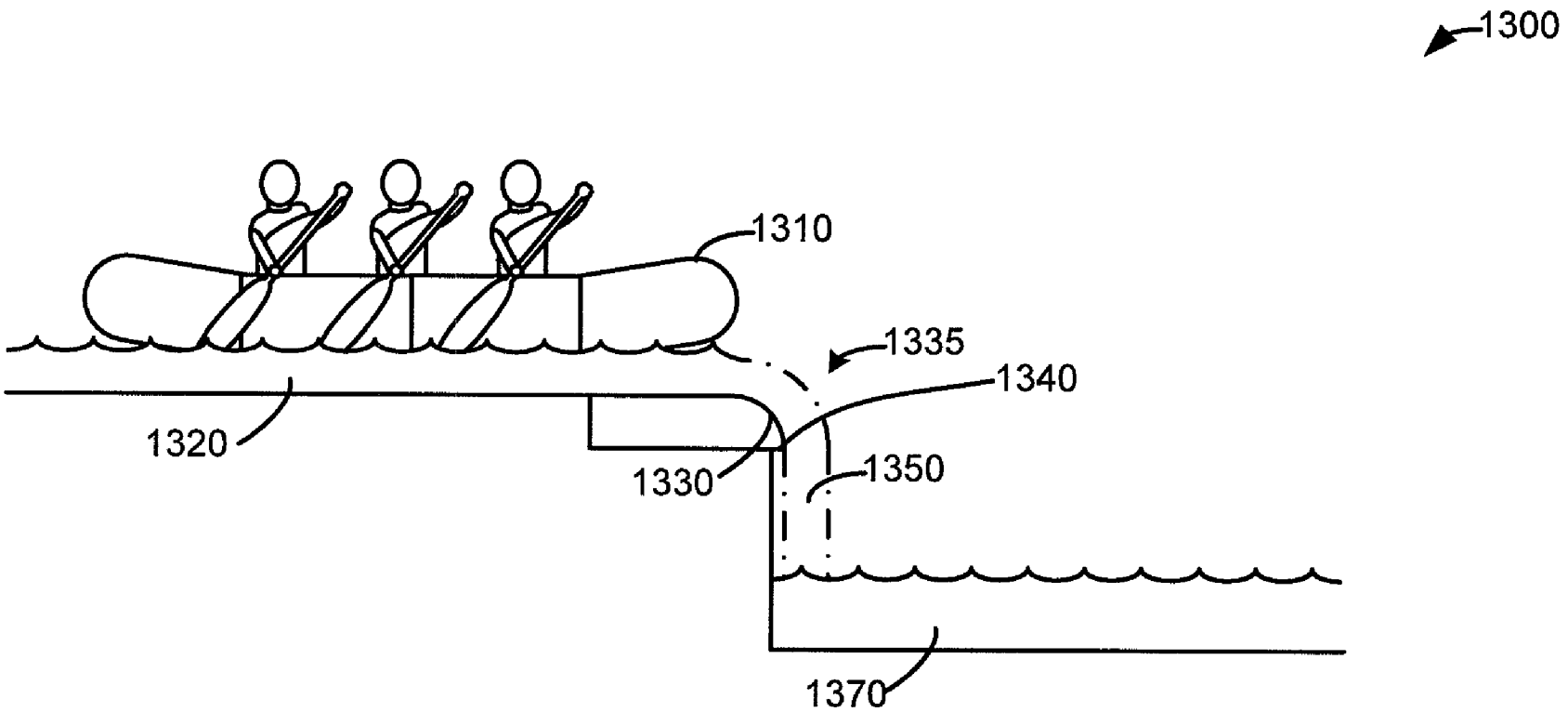
FIG. 13 is a diagram illustrating recreational waterfall cantilever in a first configuration.
Figure 14:
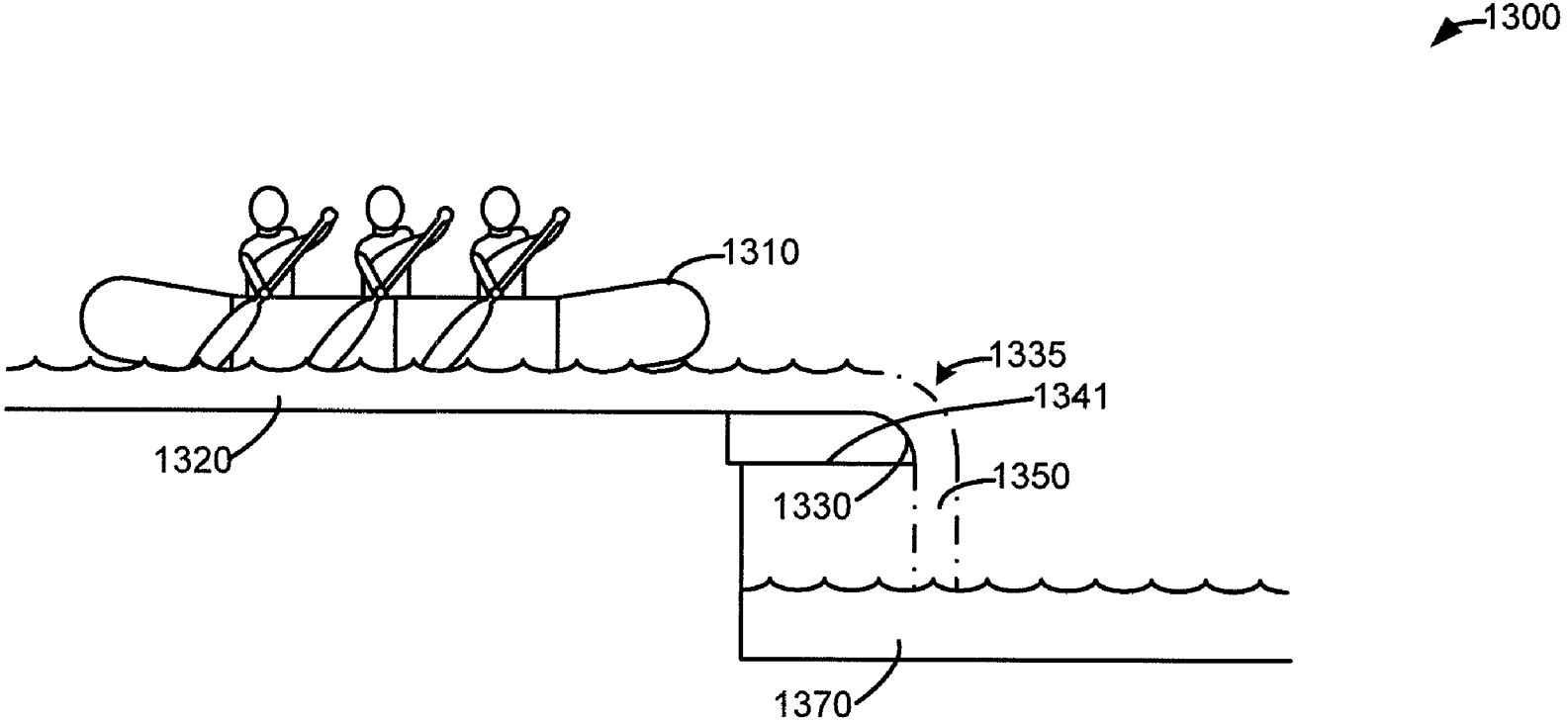
FIG. 14 is a diagram illustrating recreational waterfall cantilever in a second configuration.

FIG. 13 is a diagram illustrating recreational waterfall cantilever in a first configuration. FIG. 14 is a diagram illustrating recreational waterfall cantilever in a second configuration. In FIGS. 13-14, cantilever crest system 1300 comprises watercraft 1310, top pool 1320, cantilever crest 1330, first cantilever reach 1340, second cantilever reach 1341, nappe 1350, and bottom pool 1370. In FIG. 13, cantilever crest system 1300 is shown with a first cantilever reach 1340. In FIG. 14, cantilever crest system 1300 is shown with a second cantilever reach 1341 that is greater than the first cantilever reach 1340.

In FIGS. 13-14, cantilever crest system is shown with watercraft 1310 in top pool 1320. Cantilever crest 1330 is shown between top pool 1320 and waterfall 1335. Waterfall 1335 is shown as water pouring over cantilever crest 1330 into bottom pool 1370. First and second cantilever reaches 1340 and 1341, respectively, extend away from the upstream side of bottom pool 1370 and determine where nappe 1350 impacts the water surface of bottom pool 1370.

In an embodiment, top pool 1320 is the pool or area in which the boater is stationed before proceeding over cantilever crest 1330 on a course into bottom pool 1370. Bottom pool 1370 is the pool or area in which watercraft 1310 is landing in after traversing cantilever crest 1330 and waterfall 1335. Cantilever crest 1330 is the edge that defines the boundary between bodies of water at the water surface elevation of top pool 1320 and bodies of water that have begun to drop in elevation towards the bottom pool 1370 (e.g., waterfall 1335). Nappe 1350 is a sheet of water.

A waterfall or drop is a wetted canal upon which water flows at an angle of drop or fall between 0° (parallel to the bottom pool) and 90° between two pools (e.g., top pool 1320 and bottom pool 1370) and which is used by watercraft 1310 to navigate between these two pools. A waterfall or pour-over drop includes drops that may include vertical drops as well drops in elevation that may occur at greater or lesser angles.

Top Pool 1320 approaches and is connected to, the cantilever crest 1330 of waterfall 1335. Watercraft 1310 that is intent on navigating waterfall 1335 must approach the waterfall through top pool 1320. Top pool 1320 can range in size from the minimal size/volume required to hold a single user and their watercraft 1310, to sizes that could be much larger and would hold multiple watercrafts 1310 and/or multiple users in a single watercraft 1310.

In an embodiment, cantilever crest 1330 and a crest guidance system may vary in size and composition depending on the intended experience of waterfall 1335. Some examples include a crest guidance system intended only for use by single, narrow watercraft 1310 such as canoes and kayaks. Other examples include cantilever crests 1330 and crest guidance systems intended for use by larger watercrafts 1310 including but not limited to, rafts, inflatable kayaks, multiple and various types of watercraft 1310, multiple watercraft 1310 simultaneously, etc. In composition, the cantilever crest and crest guidance system is designed to provide watercraft 1310 with the ideal attitude to successfully navigate and paddle away from waterfall 1335.

In other embodiments, cantilever crest 1330 and crest guidance system are designed to create a specific experience such as launching watercraft 1310 away from the base of waterfall 1335. Other examples of composition include a cantilever crest 1330 and crest guidance system that causes watercraft 1310 to spin about the watercraft 1310's longitudinal axis (roll), or to cause watercraft 1310 to impact the bottom pool with various degrees of pitch, from perpendicular to the water surface of bottom pool 1370, to parallel to the bottom pool 1370 (known as "boofing"), to greater angles than parallel such that the stem end of watercraft 1310 impacts the water before the remainder of watercraft 1310.

In an embodiment, cantilever crest system 1300 sits in the flow of the water flowing over the crest of the waterfall 1335. The cantilever reaches 1340 and 1341 of cantilever crest system 1300 is designed to move the cantilever to varying distances away from the edge of the bottom pool 1370, and therefore extend the flow of the water such that it impacts bottom pool 1370 at varying distances away from the edges of bottom pool 1370. This allows cantilever crest system 1300 to control the location of the landing zone at the base of waterfall 1335. Additionally, cantilever crest system 1300 controls the nature of the flow over the drop and the shape of the nappe 1350 as it falls down to bottom pool 1370.

In an embodiment, the exit angle and surface geometry of a crest guidance system can be varied to accomplish several objectives. These objectives include, but are not limited to adjusting the angle that the water/nappe 1350 impacts bottom pool 1370, adjusting the character of the hydraulic formed at the point where the water/nappe 1350 meets bottom pool 1370, and adjusting the angle at which watercraft 1310 is launched into bottom pool 1370. Watercraft 1310 is aligned by the crest guidance system in yaw, roll, and bank angles as it approaches and navigates cantilever crest system 1300. In an embodiment, cantilever crest system 1300 ensures that watercraft 1310 (and the boaters therein) are discharged from cantilever crest system 1300 into bottom pool 1370 away from any walls or structures located in bottom pool 1370. Thus, in an embodiment, watercraft 1310 impacts bottom pool 1370 with an intended attitude and watercraft 1310 and boaters therein are able to recover control of watercraft 1310 with minimal effort and to paddle away from waterfall 1335 to calm waters.

In an embodiment, cantilever crest system 1300 can be controlled manually or by a central processing unit (CPU) that will automatically adjust the position of cantilever crest system 1300 to change the yaw, pitch or roll as is necessary depending on the nature or the condition of the water and/or the level of experience of the watercraft 1310 user.

Cantilever crest system 1300 allows a boater to navigate, in watercraft 1310, over a waterfall 1335 such that watercraft 1310 will land away from the edges/banks of bottom pool 1370 and such that they will be guided with the intention of landing with the desired pitch, yaw, and roll. The desired attitude and landing zone for watercraft 1310 can be adjusted to match the desired experience, or to land in the most controlled manner.

Figure 15:
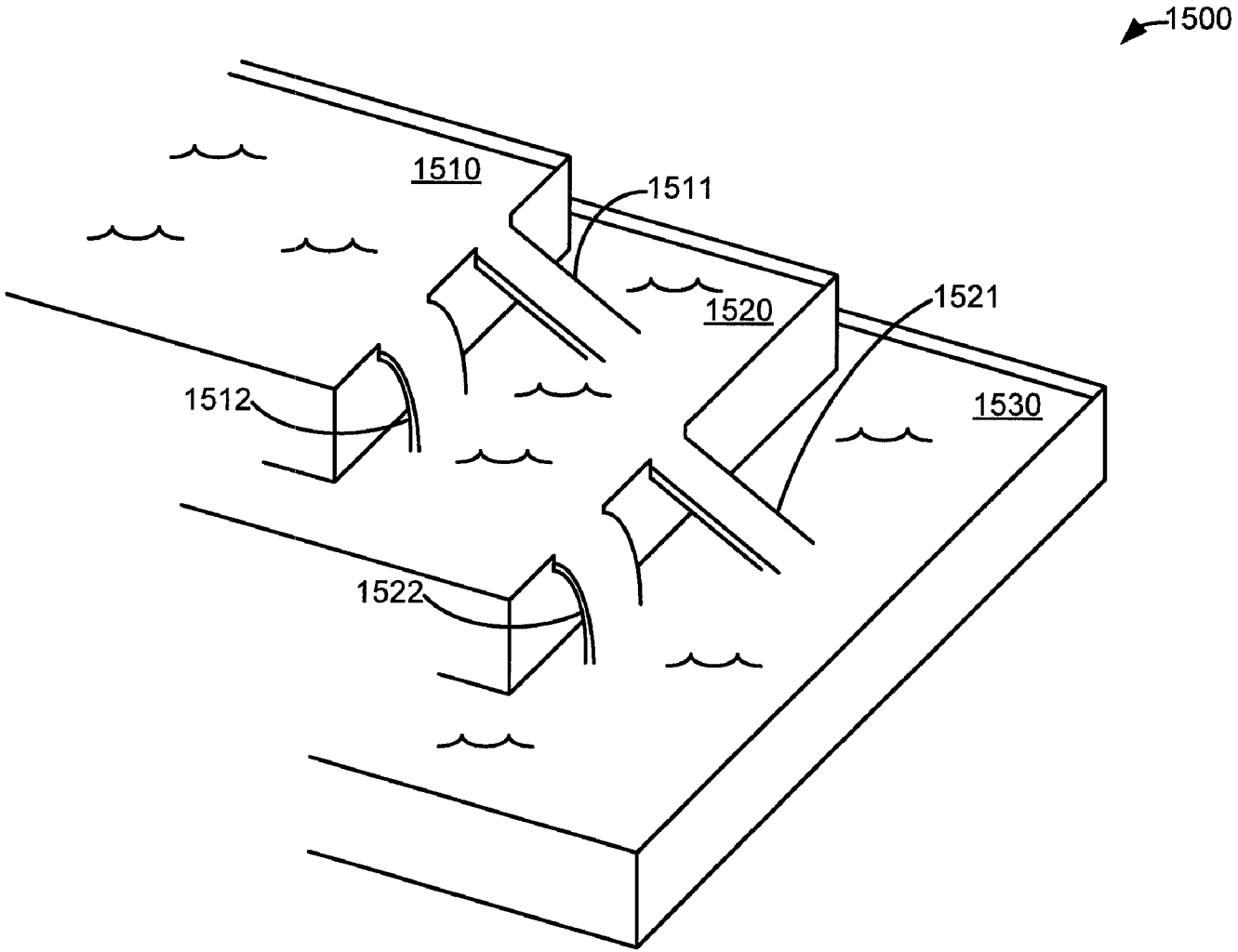
FIG. 15 is a diagram illustrating multiple route whitewater park.

FIG. 15 is a diagram illustrating a multiple route whitewater park. In FIG. 15, whitewater park 1500 comprises first pool 1510, second pool 1520, third pool 1530, first waterfall 1511, second waterfall 1512, third waterfall 1521, and fourth waterfall 1522. The water surface of first pool 1510 is at a higher elevation than the water surface of second pool 1520. First waterfall 1511 and second waterfall 1512 connect between first pool 1510 and second pool 1520. The water surface of second pool 1520 is at a higher elevation than the water surface of third pool 1530. Third waterfall 1521 and fourth waterfall 1522 connect between second pool 1520 and third pool 1530.

Whitewater park 1500 provides a system of waterfalls that connect a first pool 1510, a second pool 1520, and a third pool 1530 and provides at least two routes by which a canoe, kayak, or raft may navigate over various obstacles including, but not limited to: waterfalls, slides, cantilever waterfalls, aerial launch slides and other amenities between the pools. A user of a watercraft traversing whitewater park 1500 is provided with a variety of pathways and obstacles with interchangeable devices that the watercraft may navigate as it travels from the first pool to the third pool.

Whitewater park 1500 provides a first pool 1510 or canal that approaches, and is connected to, the upstream end of whitewater park 1500. The first pool 1510 provides some or all of the water flow to whitewater park 1500. A watercraft that is intent on navigating whitewater park 1500 will typically approach whitewater park 1500 through the first pool 1510.

First pool 1510 can range in size from the minimal size/volume required to hold a single user and their watercraft to sizes that could be much larger and would hold multiple watercrafts and/or multiple users in a single watercraft. Subsequent pools in the whitewater park 1500, including the second pool 1520 and the third pool 1530, may vary in size from the minimal size/volume required to hold a single user and their watercraft to sizes that could be much larger and would hold multiple watercraft and/or multiple users in each watercraft.

Each waterfall (1511, 1512, 1521 and 1522) or drop will feature a crest that defines the boundary between water that is at the upper elevation of a waterfall or drop and water that has already begun to fall into a pool at a lower elevation. The crest may vary in size and composition depending on the intended experience of the waterfall 1511, 1512, 1521 and 1522. Examples include waterfalls, waterfall surge systems (U.S. Provisional Patent No. 61/050,993, filed on May 6, 2008) slides, cantilever waterfall systems (U.S. Provisional Patent No. 61/055,438, filed on May 22, 2008), and Waterfall Aerial Launch Systems (U.S. Provisional Patent No. 61/055435 filed on May 22, 2008). The aformention provisional applications are hereby incorporated herein for all they describe, show, and teach for all purposes.

The nature of the waterfalls 1511, 1512, 1521 and 1522 can vary in size and composition depending on the intended experience of the waterfall 1511, 1512, 1521 and 1522, respectively. In some cases waterfall 1511, 1512, 1521 or 1522 may be vertical and the watercraft may fall vertically into the next pool. In other cases, the connecting drop may be a slide or an aerial launch system in which the watercraft falls at some angle, upon a wetted slide or waterfall launch system before being jettisoned into the subsequent pool.

Whitewater park 1500 is designed such that a watercraft under the control of a boater entering whitewater park 1500 will have multiple routes by which to navigate the whitewater park 1500 from the first pool 1510 to the third pool 1530. In an embodiment, whitewater park 1500 is designed to allow a boater to choose an easy route and a more difficult route through the whitewater park 1500.

In an embodiment, a boater may choose an easy or difficult route by which to exit from each intermediate pool (e.g., second pool 1520). In an embodiment, one route may focus on slides and aerial launch systems and another may focus on free-fall drops/waterfalls between pools 1510, 1520, and 1530. In an embodiment, some of the routes between pools 1510, 1520, and 1530 may be designed to create an ideal route for differing types of rafts, canoes, or kayaks, thereby tailoring the experience to the particular watercraft.

Whitewater park 1500 may be designed to minimize construction costs by providing more, if not many more, routes than pools 1510, 1520, and 1530 thereby reducing the need to construct as many costly pools 1510, 1520, and 1530. Whitewater park 1500 may comprise of include other economical design innovations such as the aforementioned waterfall surge system or systems that allow the entire waterfall system to be run in surges, or packages, of water such that the flow of boaters and water is efficiently controlled by the owner/operator.

Whitewater park 1500 comprises a system of interlocking pools 1510, 1520, and 1530, connected by waterfalls 1511, 1512, 1521 or 1522 that are of sufficient size and dimensions to be navigated by canoes, kayaks, or rafts. Whitewater park 1500 comprises at least a first pool 1510, at least one second pool 1520, and at least one third pool 1530. The system of waterfalls 1511, 1512, 1521 and 1522 that connect 1510, 1520, and 1530 features two or more routes by which the canoe, kayak, or raft may navigate over waterfalls, slides, cantilever waterfalls, aerial launch slides and other amenities between the subsequent pools 1520, and 1530 and thereby navigate from the first pool 1510 to the third pool 1530.

Figure 16:
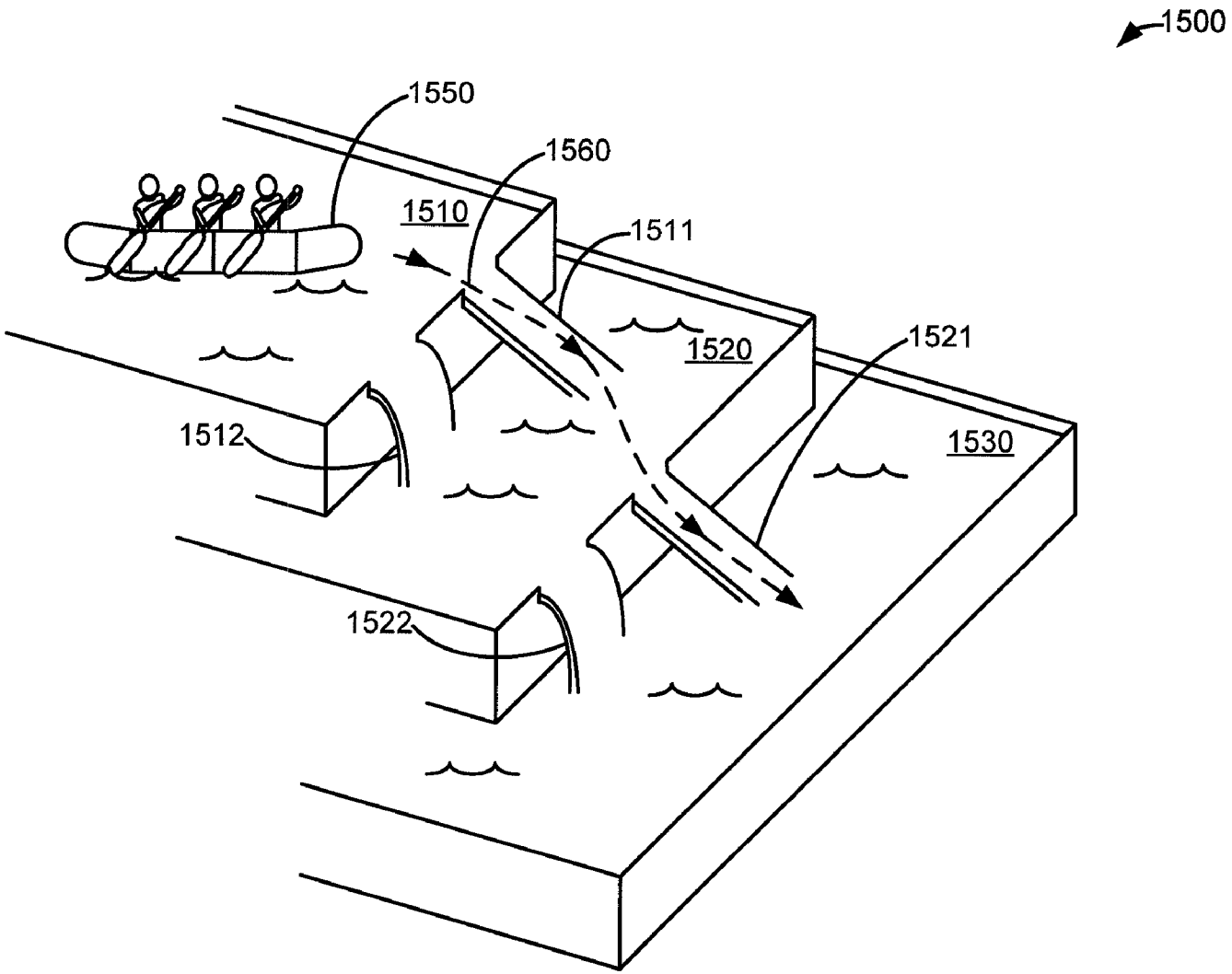
FIG. 16 is a diagram illustrating a first route through a multiple route whitewater park.
Figure 17:
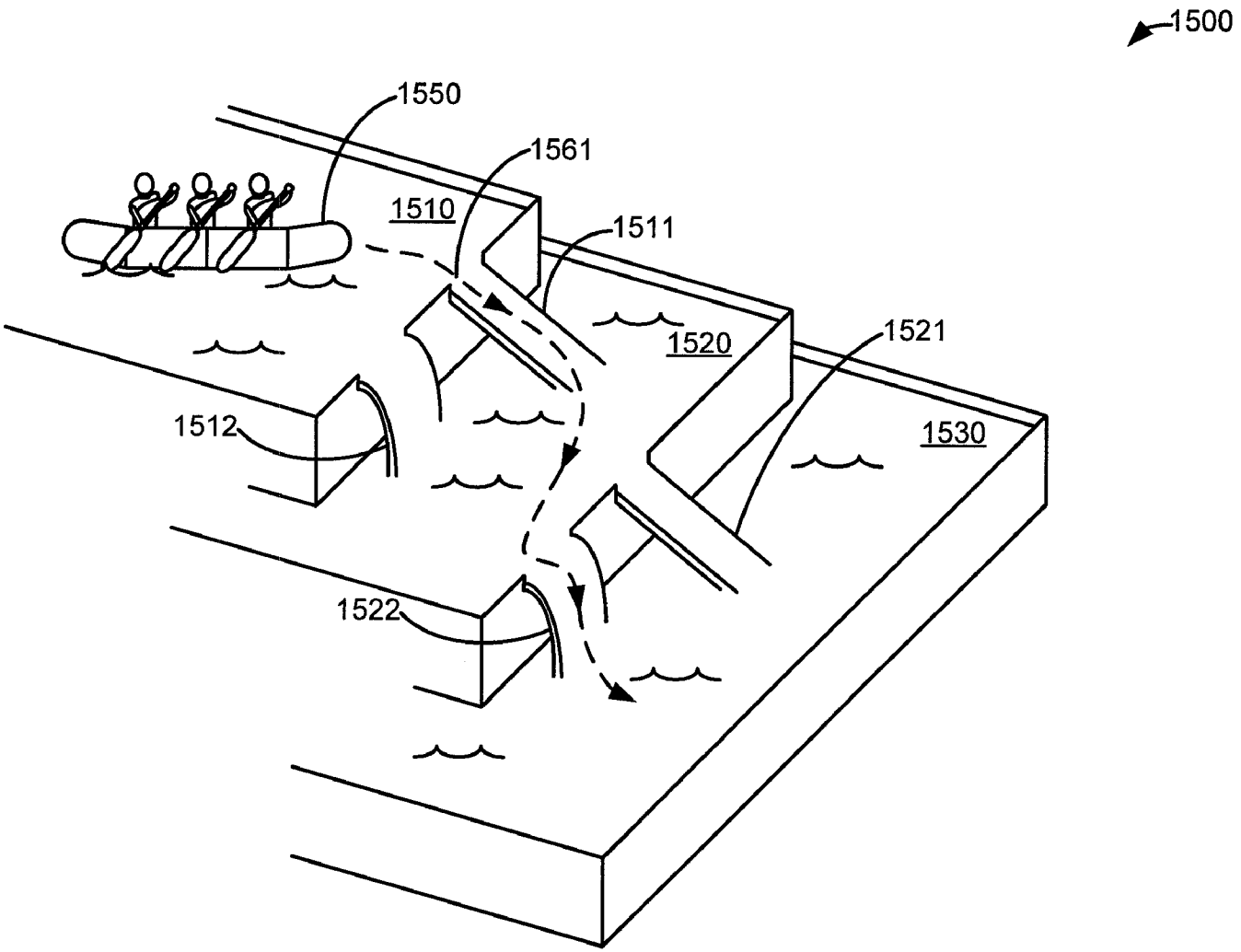
FIG. 17 is a diagram illustrating a second route through a multiple route whitewater park.

FIGS. 16 and 17 illustrate multiple routes through whitewater park 1500. FIG. 16 is a diagram illustrating a first route through a multiple route whitewater park. FIG. 17 is a diagram illustrating a second route through a multiple route whitewater park. In FIG. 16, watercraft 1550 is shown traversing a first route denoted by arrow 1560. The route indicated by arrow 1560 starts in pool 1510, down waterfall 1511 to second pool 1520, and then to pool 1530 via waterfall 1521. In FIG. 17, watercraft 1550 is shown traversing a second route denoted by arrow 1561. The route indicated by arrow 1561 starts in pool 1510, down waterfall 1511 to second pool 1520, and then to pool 1530 via waterfall 1522.

Whitewater park 1500 may have multiple routes in operation (having flow over them) at all times. Whitewater park 1500 may, at any given time, have routes in operation such that the operator may choose to allow the boater to decide which route to navigate down whitewater park 1500. Whitewater park 1500 may allow the operator, by means of check dams or gates, to choose to open only select routes down whitewater park 1500 to navigation. For example, operator may choose to allow only routes appropriate for the ability level of the current users on whitewater park 1500. In another example, the operator may only choose to run routes down whitewater park 1500 that are economical to operate at the current time.

Generally speaking, the difficulty of a waterfall 1511, 1512, 1521 and 1522 that links two calm pools (e.g., pools 1510, 1520, and 1530) is a function of the height of the drop, the amount of flow over the drop, and the geometry of the crest. Whitewater park 1500 provides a mechanism available that provides for a variety of difficulties when navigating waterfalls 1511, 1512, 1521 and 1522 that allow for a variety of difficulties while minimizing the need to construct the number of pools 1510, 1520, and 1530 required to provide separate pools for each waterfall 1511, 1512, 1521 and 1522.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A manmade recreational whitewater park, comprising: a watercraft, a first pool at a first elevation; a second pool at a second elevation that is lower than said first elevation, said second pool receiving said watercraft from said first pool via at least a first crest and a first waterfall and a second crest and a second waterfall, wherein an operator of said watercraft is able to choose between at least two routes comprising said first crest and said first waterfall being associated with a first difficulty of navigation and said second crest and said second waterfall being associated with a second difficulty of navigation that is greater than said difficulty of navigation of said first crest and said first waterfall, wherein said first waterfall and said second waterfall are each one of a cantilever waterfall, a waterfall surge system, and an aerial launch; and, a third pool at a third elevation that is lower than said second elevation, said third pool receiving said watercraft from said second pool via at least a third crest and a third waterfall and a fourth crest and a fourth waterfall, wherein said operator of said watercraft is able to choose between at least two routes comprising said third crest and said third waterfall being associated with a third difficulty of navigation, and said fourth crest and said fourth waterfall being associated with a fourth difficulty of navigation that is greater than said difficulty of navigation of said third crest and said third waterfall, wherein said third waterfall and said fourth waterfall are each one of a cantilever waterfall, a waterfall surge system, and an aerial launch.

2. The manmade recreational whitewater park of claim 1, wherein said third waterfall and said fourth waterfall are each one of a cantilever waterfall, a waterfall surge system, and an aerial launch.

3. The manmade recreational whitewater park of claim 1, wherein said first waterfall and said second waterfall are different ones of a cantilever waterfall, a waterfall surge system, and an aerial launch.

* * * * *